United States Patent [19]

Knott

[11] 4,204,363

[45] May 27, 1980

[54] LIQUID CONTAINING AMUSEMENT DEVICE

[76] Inventor: Philip H. Knott, One San Antonio Pl., San Francisco, Calif. 94133

[21] Appl. No.: 913,887

[22] Filed: Jun. 8, 1978

[51] Int. Cl.[2] ..... A63H 11/10; A63H 33/00

[52] U.S. Cl. ..... 46/202; 46/1 D

[58] Field of Search ..... 46/1 D, 141, 1 R, 41, 46/219, 202, 201, 218; 272/8 N, 8 R

[56] References Cited

U.S. PATENT DOCUMENTS

| | | | |
|---|---|---|---|
| Re. 23,612 | 1/1953 | Abel | 46/41 |
| 1,692,938 | 11/1928 | Jacobs | 46/1 D |
| 1,775,747 | 9/1930 | Ake | 272/27 N |
| 2,039,373 | 5/1936 | Wittmann | 46/141 |
| 2,540,502 | 2/1951 | Aschbacher | 58/1 R |
| 2,648,162 | 8/1953 | Mueller | 46/141 |
| 3,071,888 | 1/1963 | Knott | 46/141 |
| 3,154,882 | 11/1964 | Bossiere | 46/201 |
| 3,158,955 | 12/1964 | Sturgis | 46/201 |
| 3,187,459 | 6/1965 | Class et al. | 272/8 R |
| 3,237,340 | 3/1966 | Knott | 46/1 R |
| 3,250,531 | 5/1966 | Convertone | 272/8 N |
| 3,254,409 | 6/1966 | Gardel et al. | 30/324 |
| 3,478,443 | 11/1969 | Imris | 46/41 |

FOREIGN PATENT DOCUMENTS

| | | | |
|---|---|---|---|
| 451887 | 10/1927 | Fed. Rep. of Germany | 77 F/31 |

*Primary Examiner*—Russell R. Kinsey
*Assistant Examiner*—Michael J. Foycik, Jr.
*Attorney, Agent, or Firm*—Flehr, Hohbach, Test

[57] ABSTRACT

An amusement device including a cylindrical liquid container which appears to be either filled or empty upon rotation of the container. In one embodiment, a toy tank truck has a rotatable tank portion which includes an outer cylindrical wall and an inner cylindrical wall spaced from the outer wall to define a limited volume of space. A liquid reservoir is mounted on a portion of the outer wall whereby the reservoir may be above the limited volume of space in a fill position and below the limited volume of space in a drain position, upon rotation of the tank. Several reservoirs may be provided and each reservoir can include scoops to facilitate storage of the liquid in the reservoir.

13 Claims, 8 Drawing Figures

LIQUID CONTAINING AMUSEMENT DEVICE

BACKGROUND OF THE INVENTION

1. Field of the Invention

This invention relates generally to amusement devices and toys, and more specifically to a toy tank truck and the like in which a liquid appears and disappears upon rotation of the tank portion.

2. Prior Art

Toys and amusement devices are known in the art in which a contained fluid "disappears" by selective positioning of the device. For example, my U.S. Pat. No. 3,071,888 discloses several embodiments of double walled bottles in which a fluid contained in the wall appears to disappear as the bottle is tilted on end, whereby the contained fluid flows to a cavity in the neck of the bottle or nipple portion in the case of a baby bottle. These devices may include valve means to limit the return of the fluid from the neck reservoir to the bottle upon return of the bottle to an upright position. U.S. Pat. No. 3,250,531 to Convertine discloses other embodiments of simulated milk bottle and drinking glasses wherein the bottle or glass appears to be full of liquid when upright and in which the liquid disappears through the aid of valve means and a hidden chamber upon inversion of the bottle or glass.

In these and other similar devices the apparent disappearance of the contained fluid occurs upon inverting the device, and often valve means is required to prevent the immediate return of the fluid upon subsequent righting of the device.

SUMMARY OF THE INVENTION

An object of the present invention is an amusement device having a liquid container portion which appears to fill and empty by rotation thereof. Since the device is cylindrical, this rotation is not noticed and the filling and emptying is apparently without cause.

Another object of the invention is an amusement device in the form of a toy tank truck in which the tank portion is rotatably supported whereby the tank portion fills and empties upon rotation thereof.

Still another object of the invention is an amusement device in the form of a toy tank truck which is simple in structure.

Briefly, the amusement device in accordance with the present invention in the form of a toy tank truck includes a support frame and a generally cylindrical tank portion mounted on the support frame and axially rotatable. The tank portion includes an outer cylindrical wall and an inner cylindrical wall spaced from the outer wall to define a limited volume of space. The space defined by the two walls is filled with a liquid to give an appearance of the entire tank portion being filled. A liquid reservoir is positioned about a portion of the outer wall whereby the reservoir may be above the limited volume of space in a fill position and below the limited volume of space in a drain position. An opening in the outer cylinder wall is provided for communicating a liquid between the space between the two cylinder walls and the reservoir as the tank portion is rotated. For greater liquid storage capacity two or more reservoirs may be provided with the tank portion.

In accordance with one feature of the invention, the reservoir means is provided with a plurality of scoops for receiving and lifting liquid as the tank portion is rotated to the drain position, thereby facilitating the storage of liquid in the reservoir.

In accordance with another feature of the invention, indicator means is provided at one end of the tank portion to indicate the apparent liquid content of the tank.

The invention and objects and features thereof will be more readily apparent from the following detailed description and appended claims when taken with the drawings.

BRIEF DESCRIPTION OF THE DRAWINGS

Like elements in the drawings have the same reference numerals.

DETAILED DESCRIPTION OF THE DRAWINGS

Figure 1:
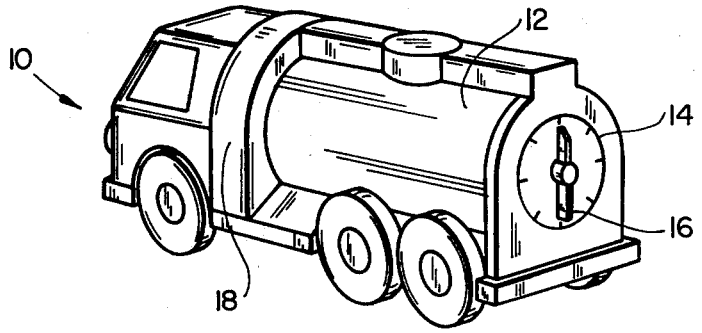
FIG. 1 is a perspective view of a toy tank truck in accordance with the present invention.

FIG. 1 is a perspective view of a toy tank truck in accordance with the present invention and includes a support frame 10 and a generally cylindrical tank 12. Tank 12 is mounted on support frame 12 to allow axial rotation of the tank, as will be described further below. A manually operable dial 14 including handle 16 is provided on one end of tank 12 to indicate whether the tank is "full" or "empty". By turning handle 16, the tank can be alternately full or empty depending on the handle position, as indicated on dial 14. The frame 10 includes a housing portion 18 which accommodates and conceals a water reservoir (not shown) which is a part of the tank portion 12 and rotates therewith as crank 16 is turned.

Figure 2:
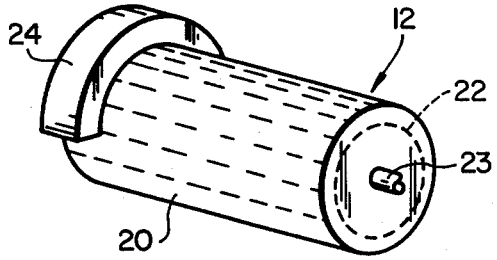
FIG. 2 and FIG. 3 are perspective views of a toy truck tank portion in a filled position and an empty position, respectively.

Referring now to FIG. 2, the tank portion 12 of the truck in FIG. 1 is shown in perspective view and includes an outer cylindrical wall 20 and an inner cylindrical wall 22 which is shown as a dotted line. The inner wall is spaced from the outer wall to define a limited volume of space for accommodating a liquid. Preferably, the two cylinders are made of plastic material and are affixed at either end to a disc to define a liquid container. In this embodiment the tank is rotatably mounted on the truck frame by means of rod 23 which extends through the tank. Alternatively, one end disc may include a hole to receive a pin from the support frame with the opposite end of the tank being peripherally supported by the frame, thereby allowing axial rotation of the tank portion. Mounted on the outer wall 20 is a liquid reservoir 24 which is capable of containing more liquid than the limited volume of space defined between the inner and outer cylindrical walls of the liquid container. An opening 26 is provided in the outer cylinder wall for communicating a liquid between the reservoir and the limited volume of space defined between the two cylinders as the tank portion is rotated.

Figure 3:
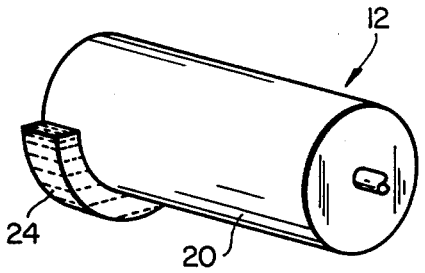

In the position shown, liquid from the reservoir will fill the cylindrical tank portion and the tank will appear to be completely filled with liquid. By rotating the tank a half revolution as shown in FIG. 3, the reservoir 24 will be below the tank and liquid will flow back to the reservoir thereby giving the appearance of the tank being empty. Importantly, at least the outer cylinder is made of transparent material whereby liquid between the two cylinder walls will be visible to an observer. A suitable dye can be added to the contained liquid to improve visibility thereof in the tank.

Figure 4:
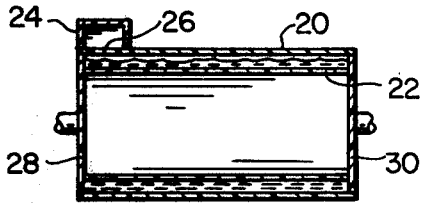
FIG. 4 is a side view in section of the tank portion illustrating the inner and outer cylindrical walls thereof.

FIG. 4 is a section view of the tank and reservoir shown in FIGS. 2 and 3 and further illustrates the construction of the tank and reservoir. The outer cylinder 20 and inner cylinder 22 are attached at either end to plates 28 and 30 to define a limited volume space between the two cylinder walls. Reservoir 24 is mounted on the outer wall with opening 26 providing for liquid passage between the reservoir and the tank. Again, it should be appreciated that the volume of liquid which may be contained in reservoir 24 will be equal to or greater than the volume of liquid which can be accommodated between the two cylinders, thereby to completely drain all liquid from the tank when the reservoir is in a drain position.

Figure 5:
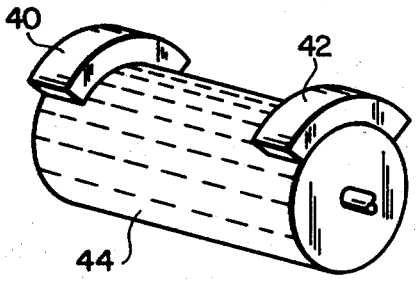
FIG. 5 and FIG. 6 are perspective views of another embodiment of the tank portion in accordance with the invention in a filled position and an empty position, respectively.
Figure 6:
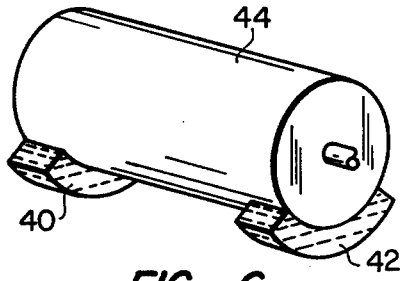

To increase the reservoir capacity of the tank, a liquid reservoir can be provided on either end of the tank as shown in FIGS. 5 and 6. In FIG. 5 the reservoirs 40 and 42 are in an upper position and liquid fills the space in tank 44 to give the appearance of the tank being full. In FIG. 6 the tank has been rotated 180° with the reservoirs in a bottommost position and the liquid from tank 44 flows back into the reservoirs 40 and 42.

Figure 7:
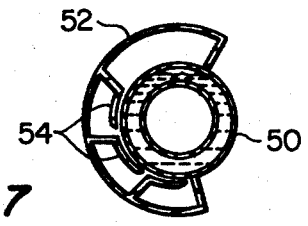
FIG. 7 and FIG. 8 are section views of the tank portion and reservoir in a filled position and an empty position, respectively, in accordance with another embodiment of the invention.
Figure 8:
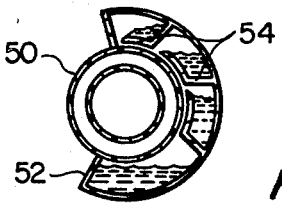

In another embodiment of the invention, the reservoir can be provided with a plurality of scoops for lifting the liquid as the tank is rotated from a full position to the empty position. FIG. 7 and FIG. 8 are cross section views of the tank 50 and reservoir 52 with the tank filled and the tank empty, respectively. Scoops 54 within the reservoir 52 receive and confine the liquid as the tank is rotated from a full position in FIG. 7 to the empty position of FIG. 8, thereby allowing a lower profile of the reservoir by extending its length about the tank 50.

An amusement device in accordance with the present invention provides for the simulation of a full or empty liquid container by rotation thereof. The device can be implemented in a relatively simple structure and without the use of valves and the like. While the invention has been described with reference to specific embodiments, the description is illustrative of the invention and is not to be construed as limiting the invention. Modifications and changes familiar to those skilled in the art without departing from the true spirit and scope of the invention as defined by the appended claims.

What is claimed is:

1. A toy tank truck comprising:

a support frame, a generally cylindrical tank rotatably mounted on said support frame, said tank including an outer cylinder wall and an inner cylinder wall spaced from said outer wall to define a chamber having a limited volume of space, a liquid reservoir on said outer wall rotatably positionable above said chamber in a fill position and below said chamber in a drain position, and an opening in said outer wall for communicating a liquid between said chamber and said reservoir as said tank is rotated.

2. A toy tank truck as defined in claim 1 wherein said outer cylinder wall is transparent.

3. A toy tank truck as defined by claim 1 and further including indicator means at one end of said tank to indicate the apparent liquid content of said tank.

4. A toy tank truck as defined by claim 2 wherein said indicator means includes crank means for rotating said tank.

5. A toy tank truck as defined by claim 1 wherein said reservoir includes a plurality of scoops for receiving and lifting liquid as said tank is rotated from said fill position to said drain position.

6. A toy tank truck as defined by claim 1 and further including a second liquid reservoir mounted on and positioned about a portion of said outer wall.

7. A toy tank truck as defined by claim 6 wherein said first and second reservoirs are positioned on opposing ends of said outer wall.

8. A toy tank truck as defined by claim 7 and further including indicator means at one end of said tank to indicate the apparent liquid content of said tank.

9. A toy tank truck as defined by claim 7 wherein each of said first and second reservoirs includes a plurality of scoops for receiving and lifting liquid as said tank is rotated from said fill position to said drain position.

10. For use in an amusement device which appears to store and dispense a liquid, a liquid container of generally cylindrical configuration which is rotatably supported on a horizontal axis, said container comprising an outer cylindrical wall and an inner cylindrical wall spaced from said outer wall to define a chamber having a limited volume of space, a liquid reservoir mounted on said outer wall and rotatably positionable above said chamber in a fill position and below said chamber in a drain position, and an opening in said outer cylinder wall for communicating a liquid between said chamber and said reservoir as said liquid container is rotated.

11. A liquid container as defined by claim 10 wherein said outer cylindrical wall is transparent.

12. A liquid container as defined by claim 10 wherein said reservoir includes a plurality of scoops for receiving and lifting liquid as said container is rotated from a fill position to a drain position.

13. A liquid container as defined by claim 12 and further including indicator means at one end of said container to indicate the apparent liquid content of said container, said indicator means including crank means for rotating said container.

* * * * *